US009055357B2

(12) United States Patent
Burns

(10) Patent No.: US 9,055,357 B2
(45) Date of Patent: Jun. 9, 2015

(54) MULTI-DIRECTIONAL AND OMNIDIRECTIONAL HYBRID MICROPHONE FOR HEARING ASSISTANCE DEVICES

(71) Applicant: Starkey Laboratories, Inc., Eden Prairie, MN (US)

(72) Inventor: Thomas Howard Burns, St. Louis Park, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 124 days.

(21) Appl. No.: 13/734,824

(22) Filed: Jan. 4, 2013

(65) Prior Publication Data

US 2013/0195297 A1 Aug. 1, 2013

Related U.S. Application Data

(60) Provisional application No. 61/583,588, filed on Jan. 5, 2012.

(51) Int. Cl.
*H04R 3/00* (2006.01)
*H04R 25/00* (2006.01)

(52) U.S. Cl.
CPC ..... *H04R 3/005* (2013.01); *H04R 2410/01* (2013.01); *H04R 25/405* (2013.01); *H04R 25/407* (2013.01)

(58) Field of Classification Search
CPC .... H04R 3/005; H04R 25/405; H04R 25/407; H04R 2410/01
USPC ..... 381/313, 356
See application file for complete search history.

(56) References Cited

U.S. PATENT DOCUMENTS

| | | | | |
|---|---|---|---|---|
| 5,524,056 | A | 6/1996 | Killion et al. | |
| 7,065,220 | B2 | 6/2006 | Warren et al. | |
| 7,103,191 | B1 * | 9/2006 | Killion | 381/313 |
| 7,116,792 | B1 | 10/2006 | Taenzer et al. | |
| 7,174,022 | B1 * | 2/2007 | Zhang et al. | 381/92 |
| 7,324,649 | B1 | 1/2008 | Knapp et al. | |
| 7,359,520 | B2 * | 4/2008 | Brennan et al. | 381/92 |
| 7,415,117 | B2 * | 8/2008 | Tashev et al. | 381/92 |
| 7,471,798 | B2 * | 12/2008 | Warren | 381/92 |
| 7,542,580 | B2 * | 6/2009 | Burns | 381/313 |
| 8,077,892 | B2 * | 12/2011 | Dijkstra et al. | 381/315 |
| 8,903,106 | B2 * | 12/2014 | Meyer et al. | 381/92 |
| 2009/0323992 | A1 | 12/2009 | Burns | |
| 2013/0343571 | A1 * | 12/2013 | Rayala et al. | 381/92 |

* cited by examiner

*Primary Examiner* — Curtis Kuntz
*Assistant Examiner* — Ryan Robinson
(74) *Attorney, Agent, or Firm* — Schwegman Lundberg & Woessner, P.A.

(57) ABSTRACT

Disclosed herein, among other things, are methods and apparatus for an directional microphone arrays for hearing assistance devices. In various embodiments, the present subject matter provides a microphone array system for receiving sounds including a first directional microphone, a second directional microphone and an omnidirectional microphone. The first directional microphone has a first directional axis in a first direction, and the second directional microphone has a second directional axis that is collinear with the first direction and pointing in the same direction as the first direction. The omnidirectional microphone has a sound sampling position that is a disposed between the first directional microphone and the second directional microphone, and the omnidirectional microphone sound sampling position is on or about the first directional axis. Weighted outputs of the first directional microphone, second directional microphone, and omnidirectional microphone are processed to provide a second order directional microphone system, according to various embodiments.

30 Claims, 14 Drawing Sheets

MULTI-DIRECTIONAL AND OMNIDIRECTIONAL HYBRID MICROPHONE FOR HEARING ASSISTANCE DEVICES

CROSS REFERENCE TO RELATED APPLICATIONS

The present application claims the benefit under 35 U.S.C. 119(e) of U.S. Provisional Patent Application Ser. No. 61/583,588, filed Jan. 5, 2012, which is hereby incorporated by reference in its entirety.

TECHNICAL FIELD

This document relates generally to hearing assistance systems and more particularly to hearing aids having directional microphones.

BACKGROUND

Hearing aids are used to assist people suffering hearing loss by transmitting amplified sounds to their ear canal. Many designs have been proposed to provide more natural sound reception and processing to aid the wearer. Improvements in signal processing and components are needed to better refine the sound played to the wearer. One such area of improvement is in the type of microphone used to receive the sound.

SUMMARY

Disclosed herein, among other things, are methods and apparatus for an directional microphone arrays for hearing assistance devices. In various embodiments, the present subject matter provides a microphone array system for receiving sounds including a first directional microphone, a second directional microphone and an omnidirectional microphone. The first directional microphone has a first directional axis in a first direction, and the second directional microphone has a second directional axis that is collinear with the first direction and pointing in the same direction as the first direction. The omnidirectional microphone has a sound sampling position that is a disposed between the first directional microphone and the second directional microphone. According to various embodiments, the omnidirectional microphone sound sampling position is on or about the first directional axis. Weighted outputs of the first directional microphone, second directional microphone, and omnidirectional microphone are processed to provide a second order directional microphone system, according to various embodiments.

In various embodiments, the present subject matter provides a method of receiving sounds using a microphone array. According to various embodiments the method includes providing a first directional microphone having a first directional axis in a first direction, and providing a second directional microphone having a second directional axis that is collinear with the first direction and pointing in the same direction as the first direction. An omnidirectional microphone is provided having a sound sampling position that is a disposed between the first directional microphone and the second directional microphone, wherein the omnidirectional microphone sound sampling position is on or about the first directional axis. In various embodiments, weighted outputs of the first directional microphone, second directional microphone, and omnidirectional microphone are processed to provide a second order directional microphone system.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1A:
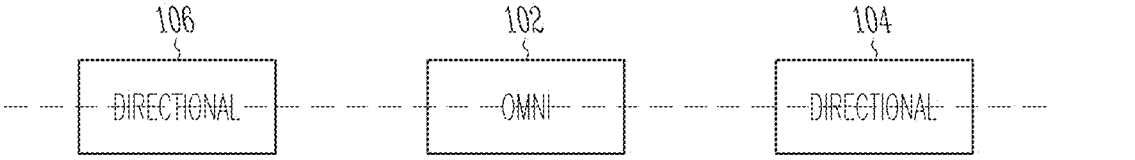
FIG. 1A is a block diagram illustrating a microphone system for a hearing assistance device, according to one embodiment of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a microphone system for a hearing assistance device. The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as head worn hearing devices whether custom fitted, standard fitted, open fitted or occlusive fitted. The present subject matter can be used in a device that is not worn on the ear or in the ear. It is understood that other hearing assistance devices not expressly stated herein may be used in conjunction with the present subject matter.

A directional microphone array (DMA) is used in hearing instruments to provide higher signal-to-noise ratios for users subjected to ambient noise, and thus better speech intelligibility, e.g., in noisy restaurants. For hearing instruments, endfire DMAs in delay-and-sum configurations are typically used for first-order directionality, and similarly in some rare second-order systems. Conventionally, such systems are designed and optimized in freefield and then placed in-situ on a user's head, thereby producing a directional pattern far different than its original freefield design, and consequently far inferior. In order for such systems to be successful, the transducers must be stringently matched in sensitivity and phase (i.e., time-delay) and it is critical that they do not drift apart with age—which is difficult to ensure.

The present subject matter provides an improved DMA technology that may be optimized in-situ and will operate robustly with respect to both transducer mismatch and drift and also to placement of the hearing instrument on the user. In one embodiment of the present subject matter, two dipole microphones positioned relatively equally and relatively symmetrically on either side of a third omnidirectional microphone, such that the directional axes of the dipoles are relatively collinear to each other and to the omnidirectional microphone. Other variations of this approach are contemplated and the design may vary depending on available components, real estate, signal processing, and application.

In one embodiment, an integrated dual dipole omni (DDO) directional microphone array (DMA) is configured in a hearing instrument. Other applications are possible, and the DDO DMA may be employed in any hearing reception or assistance device. The present DDO DMA provides robust directional performance for the user in a relatively small and compact package. This configuration provides exceptional directional performance over wide variance of microphone sensitivity and phase mismatch, including drift with age.

In one method, the DDO DMA is placed in a hearing aid and positioned in-situ on a person or measurement manikin. The complex head related transfer functions (HRTFs) are measured of each mic (for example, as per ANSI S3.35 (2004), see ANSI 53.35 "Method of measurement of performance characteristics of hearing aids under simulated rear-ear working conditions." *Acoust. Soc. of Amer.* (2004), which is hereby incorporated by reference in its entirety), phase and magnitude (see, for example, Burns, T., "Microphone placement in hearing assistance devices to provide controlled directivity." US Patent Publication No. 2009/0323992, filed May 28, 2009, which is incorporated by reference in its entirety) of each mic's HRTF is adjusted, and then all three signals are combined to increase and/or optimize the directional performance, such that a robust, higher-order DMA can be achieved.

FIG. 1A is a block diagram illustrating a microphone system 100 for a hearing assistance device, according to one embodiment of the present subject matter. FIG. 1A shows an omnidirectional microphone 102 configured between a first directional microphone 106 and a second directional microphone 104. In various embodiments, the first directional microphone 106 and the second directional microphone (104) have microphone reception patterns that are pointing in the same direction. Therefore, in this variation example, if the maximum direction of reception for microphone 106 is to the right (pointing to the direction of the omnidirectional microphone), then the direction of the maximum reception pattern of microphone 106 is also to the right (that is, away from the omnidirectional microphone).

Figure 1B:
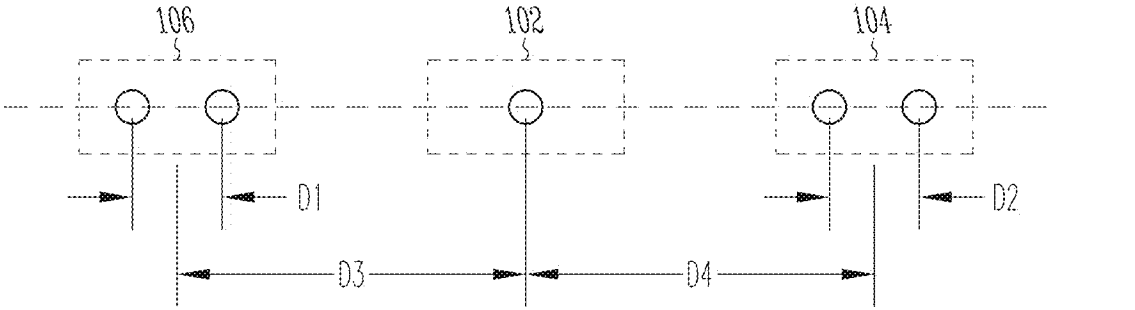
FIG. 1B is a diagram showing sound ports for the microphone system of FIG. 1A, according to one embodiment of the present subject matter.

As can be seen from comparing FIG. 1A to FIG. 1B, the three microphones sense sound at five spatial locations, indicated by the five sound holes on FIG. 1B. In various embodiments, the distance between the sound holes on microphone 104 (D2) is about the same distance as the distance for the sound holes for the other directional microphone 106 (D1). In various embodiments, the distance of the omnidirectional microphone 102 sound sample point to a directional microphone 104 sound sample point (D4) is about the same distance as the omnidirectional microphone 102 sound sample point to a sound sample point of the directional microphone 106. In various embodiments, the sound sample points (2 for each of the directional microphones and 1 for the omnidirectional microphone) or microphone holes are aligned to be on about the same axis. In various embodiments, the microphone sound sampling locations are aligned about the same axis and are symmetrically placed about the omnidirectional sound sampling location. Thus, the sound sample locations (where sound is sampled) are of interest (e.g., sound holes). It is possible that various sound sample locations (e.g., sound holes) may be separate from their respective microphones by a distance. For example, they can be separated by a sound conduit or chamber. Therefore, the present subject matter takes into consideration the sound sampling location(s) as opposed to where the microphone is situated in a device. Therefore, it is understood that the microphones may be placed in different positions as long as the sound sampling positions are maintained about a linear axis and with the desired placement about the omnidirectional sound sampling point.

Figure 2:
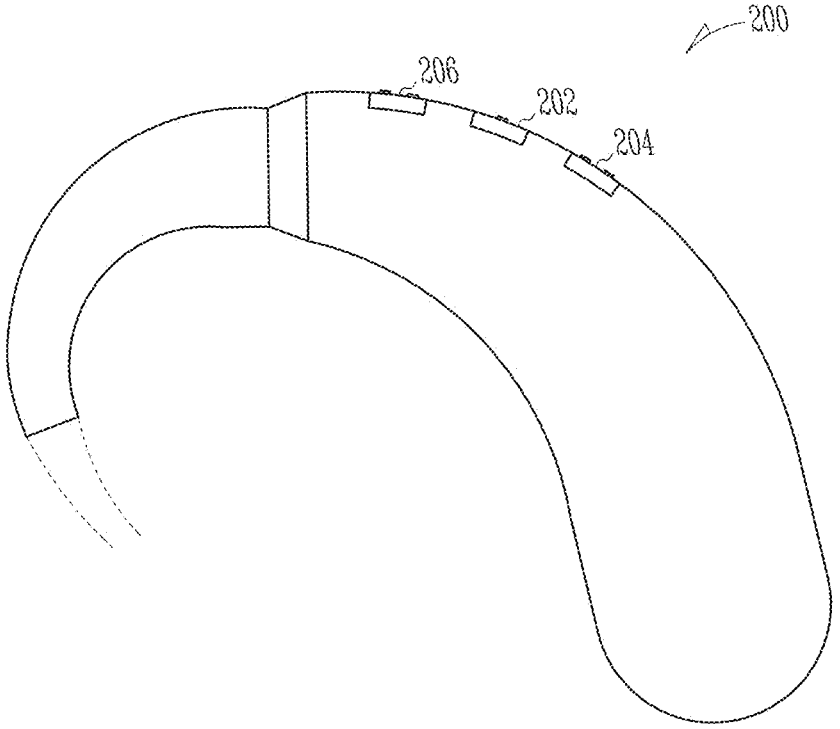
FIG. 2 is a diagram illustrating an example of the microphone system of the present subject matter in a housing adapted to be worn behind the ear or over the ear, according to various embodiments of the present subject matter.
Figure 3:
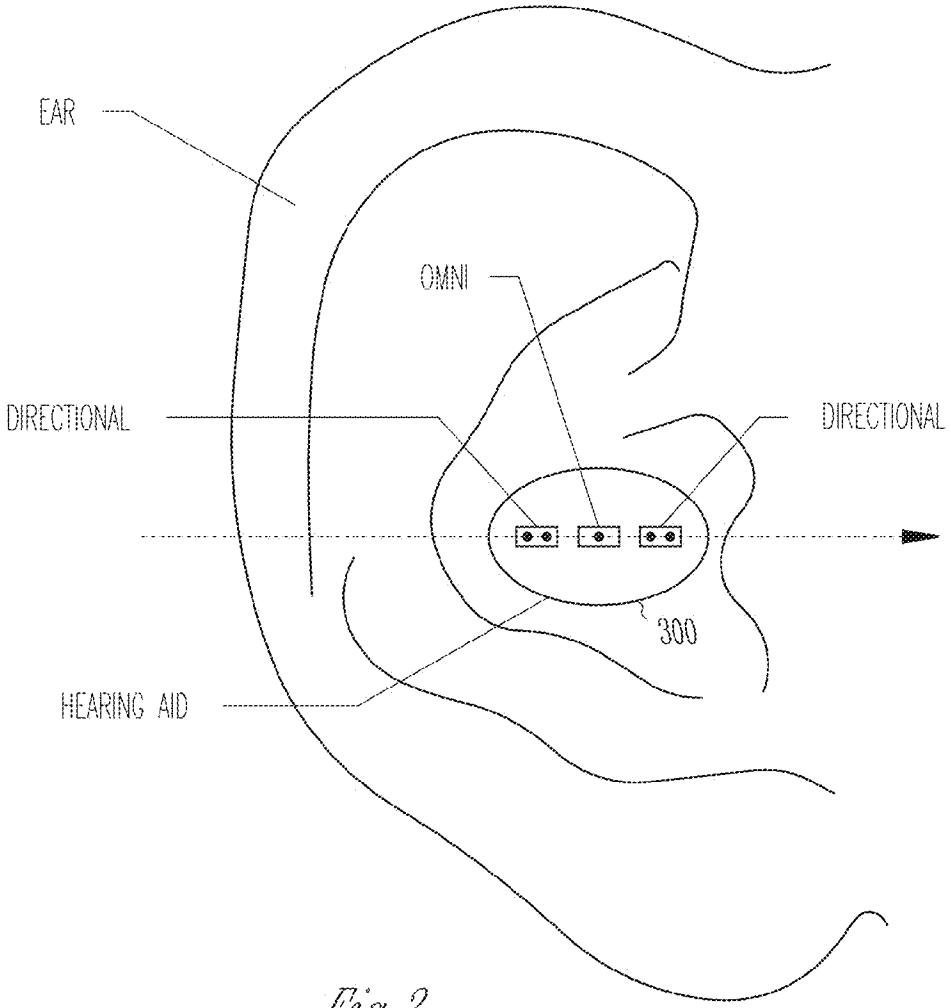
FIG. 3 is a diagram illustrating an example of the microphone system of the present subject matter in a housing adapted to be worn in the ear or ear canal, according to one embodiment of the present subject matter.

The present microphone array can be situated in a number of configurations and devices. FIGS. 2 and 3 demonstrate just some of the configurations that may be employed. Other devices, configurations, and applications are possible without departing from the scope of the present subject matter.

FIG. 2 is a diagram illustrating an example of the microphone system of the present subject matter in a housing 200 adapted to be worn behind the ear or over the ear, according to various embodiments of the present subject matter. Omnidirectional microphone 202 is situated between directional microphones 206 and 204 to provide the microphone array of the present subject matter. It is understood that the microphone assemblies can be positioned at different places in the housing, provided that the sound sampling positions are configured to be in a line as shown in FIG. 1B. Therefore, the exact placement of the microphone components may vary provided that the sound sampling positions are approximately linear as described herein. Furthermore, it is possible that the sound sampling portions can be disposed along different surfaces and directions of the housing 200. In the example shown in FIG. 2 the sound sampling positions are about the top of the housing 200. In various embodiments, the sound sampling positions are on the side of the housing. In various embodiments, the sound sampling positions are elevated to change the axis of the sound sampling positions. Therefore, the example shown in FIG. 2 is demonstrative and not intended in an exhaustive or limiting sense. The present microphone can be used in various types of hearing aids, including, but not limited to, behind-the-ear (BTE) hearing aids and receiver-in-canal (RIC) hearing aids (also known as receiver-in-the-ear or RITE hearing aids).

FIG. 3 is a diagram illustrating an example of the microphone system of the present subject matter in a housing 300 adapted to be worn in the ear or ear canal, according to one embodiment of the present subject matter. In this embodiment, five sound holes are aligned in the face plate of the hearing aid housing 300. These five sound holes can be situated to provide the desired axial configuration for the present microphone system. As before, the omnidirectional microphone is situated between the directional microphones to provide the microphone array of the present subject matter. In various embodiments, the primary reception direction of the directional microphones is oriented in the same direction. It is understood that the microphone assemblies can be positioned at different places within the housing, provided that the sound sampling positions are configured to be in a line, such as shown in FIG. 1B. Therefore, the exact placement of the microphone components may vary provided that the sound sampling positions are approximately linear as described herein. Furthermore, it is possible that the sound sampling portions can be disposed along different directions of the housing 300. In various embodiments, the sound sampling positions are elevated to change the axis of the sound sampling positions. Therefore, the example shown in FIG. 3 is demonstrative and not intended in an exhaustive or limiting sense. Thus, the present microphone array can be disposed in the faceplate of different hearing aids, including, but not limited to, an in-the-ear hearing aid (ITE). The present microphone can be used in custom fitted devices or standard fit devices.

Figure 4:
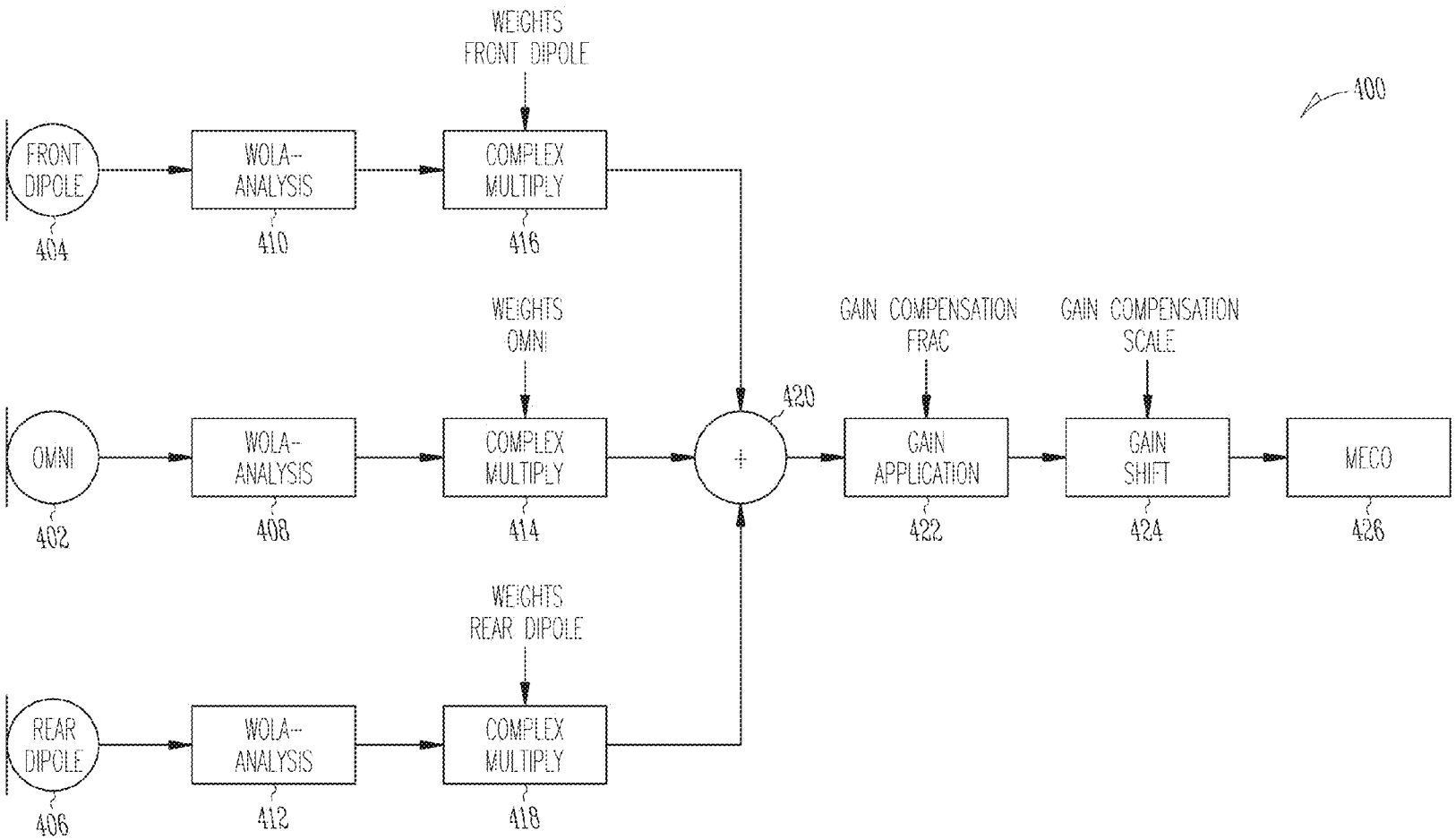
FIG. 4 is a signal flow diagram illustrating one example of signal processing system configured to receive and process signals from the microphone system of the present invention, according to one embodiment of the present subject matter.

FIG. 4 is a signal flow diagram illustrating one example of signal processing system 400 configured to receive and process signals from the microphone system of the present invention, according to one embodiment of the present subject matter. In this embodiment, front dipole microphone 404 provides a signal to weighted overlap-add (WOLA) analysis (or other frequency analysis process) block 410. The output of block 410 is to a complex multiplication process 416 with weighting applied to appropriately increase and/or optimize the directional performance of the system. The rear dipole (directional) microphone 406 also has a frequency analysis block 412 (which is a WOLA analysis process in various embodiments). A complex multiplication process 418 is used in conjunction with weights associated with the rear directional microphone to increase and/or optimize the directional performance of the system. The omnidirectional microphone 402 provides its signal to a frequency analysis block 408 (which is a WOLA analysis block in various embodiments) and then to the complex multiplication process 414 with weights associated with the omnidirectional microphone. The weighting of all of the microphone signals can be increased and/or optimized as programmed by the system. Such increase and/or optimization may be done in three dimensions. The resulting signals are added by summing node 420 and a gain is applied at block 422. The resulting signal is further processed buy gain shift module 424 and output control limiting algorithm (MECO) 426. It is understood that this is only one approach and that different signal flow systems may be employed without departing from the scope of the present subject matter. The present processing can be done in a digital signal processor (DSP) or microprocessor or microcontroller. It is understood that the processing can be done in a processor of a hearing aid in such applications. The present system can be employed to provide a second order directional system.

The weights used to optimize the directivity are based on in-situ empirical data acquired a priori on a measurement manikin, representing the nominal dimensions of a person.

Typically, higher-order DMAs require that the dipole distance between the front and rear inlets of an individual dipole be much smaller than the overall aperture distance between the farthest dipoles in the array. The present DDO DMA provides higher-order directionality in much smaller aperture distances, typically on the order of the dipole distance itself in various embodiments. Given the aspect ratio of the dimensions of typical hearing instrument microphones, this allows them to be stacked very tightly, even on top of one another, as shown in the embodiments of FIGS. 6A-15. Spouts attached over microphone inlets are not needed with the present system, thereby allowing the DDO DMA to be integrated in the housing of a hearing instrument without the need of acoustical seals between the spouts and the housing in various embodiments. In addition, the lack of a need for spouts eliminates the acoustical inertances due to the air in the spouts that reduce the overall system sensitivity at high frequencies, reduce the maximum stable gain of the hearing instrument, and reduce the directional robustness.

Figure 5A:
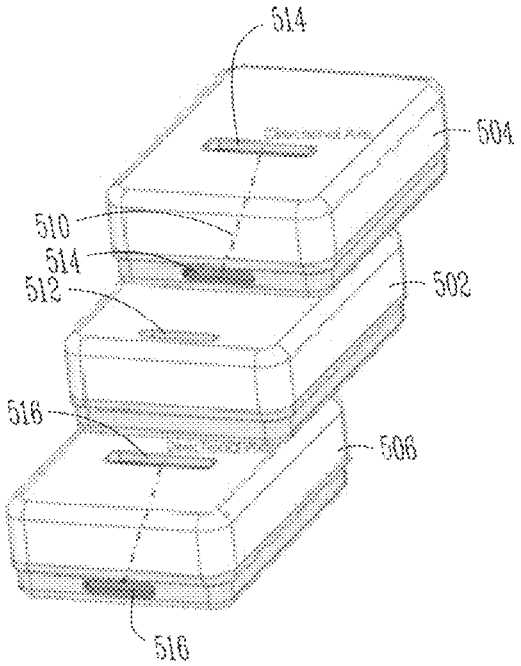
FIGS. 5A-16 are diagrams illustrating examples of positioning of hearing assistance device microphones, according to various embodiments of the present subject matter.
Figure 5B:
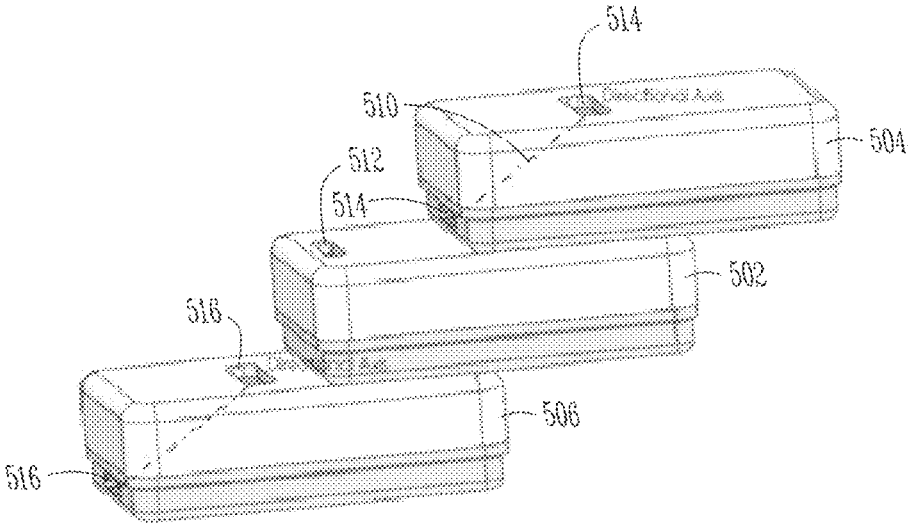

FIG. 5A illustrates an oblique view and FIG. 5B a side view of a tri-stacked and staggered DDO DMA, according to an embodiment of the present subject matter. Each microphone has an individual housing, and the housings have a parting line 510 to indicate the relative orientation of the internal microphone cartridge diaphragm, in the depicted embodiment. An omni microphone 502 contains one inlet 512 positioned on one side of the diaphragm parting line while a dipole microphone (504, 506) contains two inlets (514, 516) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 6A:
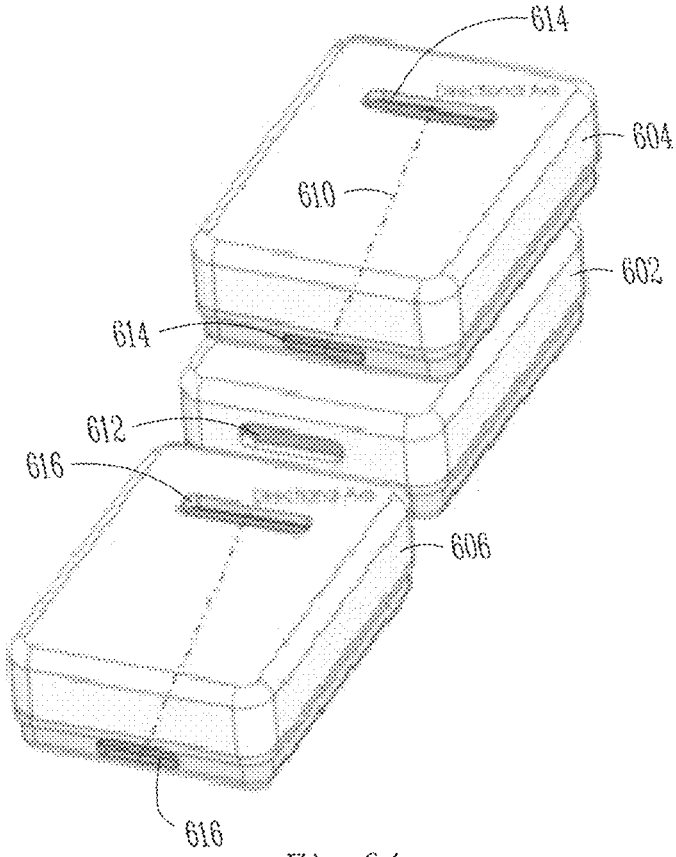
Figure 6B:
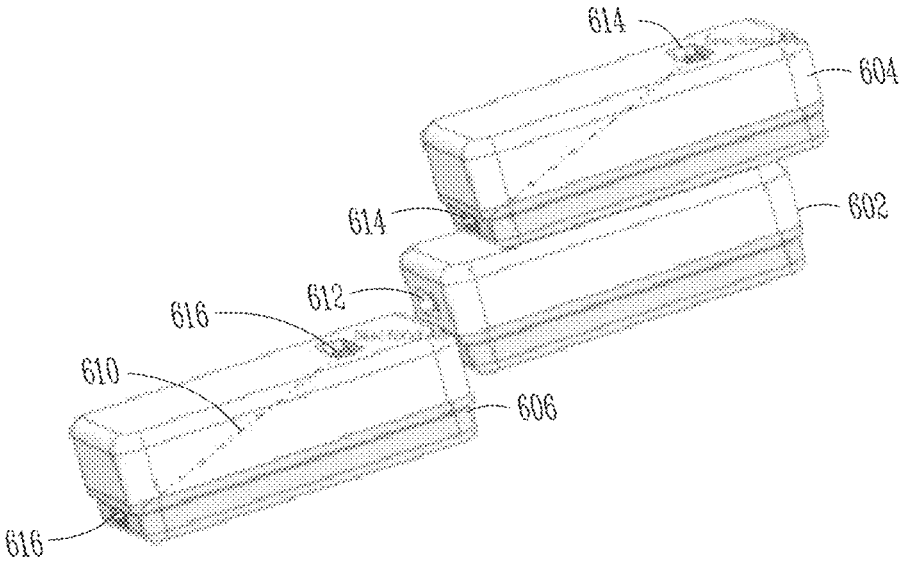

FIG. 6A illustrates an oblique view and FIG. 6B a side view of a dual-stacked and staggered DDO DMA, according to an embodiment of the present subject matter. Each microphone has an individual housing, and the housings have a parting line 610 to indicate the relative orientation of the internal microphone cartridge diaphragm, in the depicted embodiment. An omni microphone 602 contains one inlet 612 positioned on one side of the diaphragm parting line while a dipole microphone (604, 606) contains two inlets (614, 616) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 7:
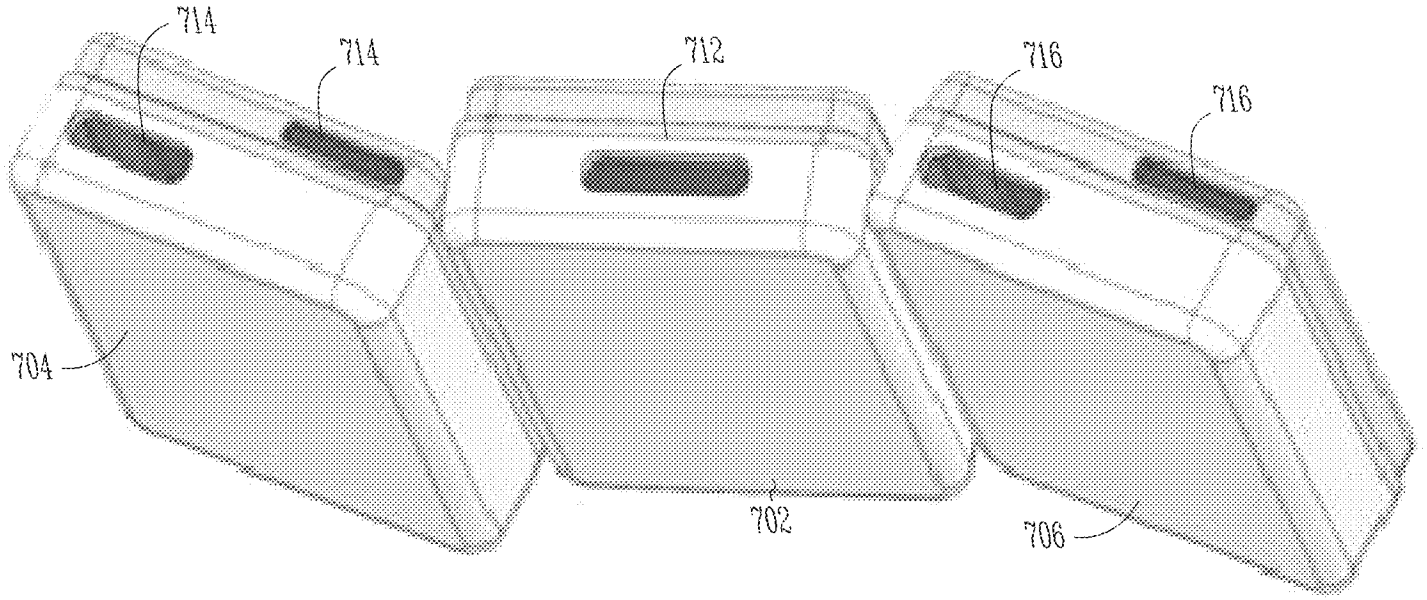

FIG. 7 illustrates an oblique view of a DDO DMA, according to an embodiment of the present subject matter. An omni microphone 702 contains one inlet 712 positioned on one side of the diaphragm parting line while a dipole microphone (704, 706) contains two inlets (714, 716) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 8A:
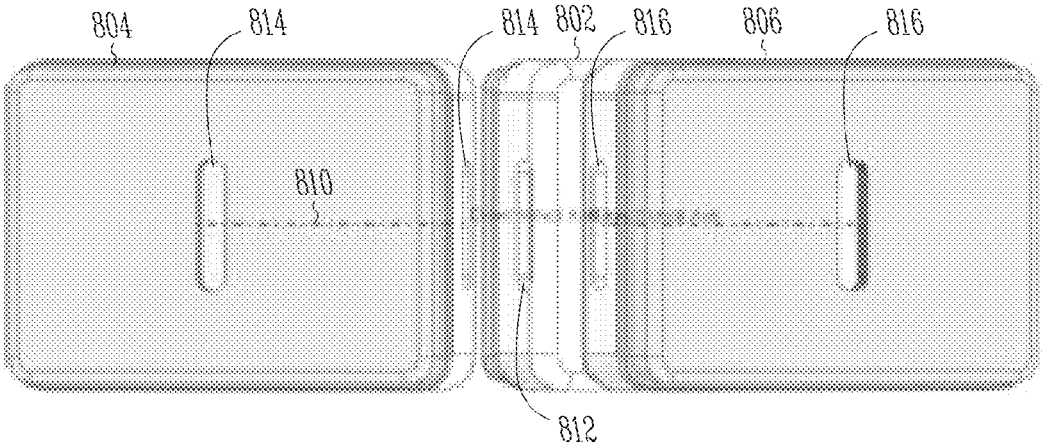
Figure 8B:
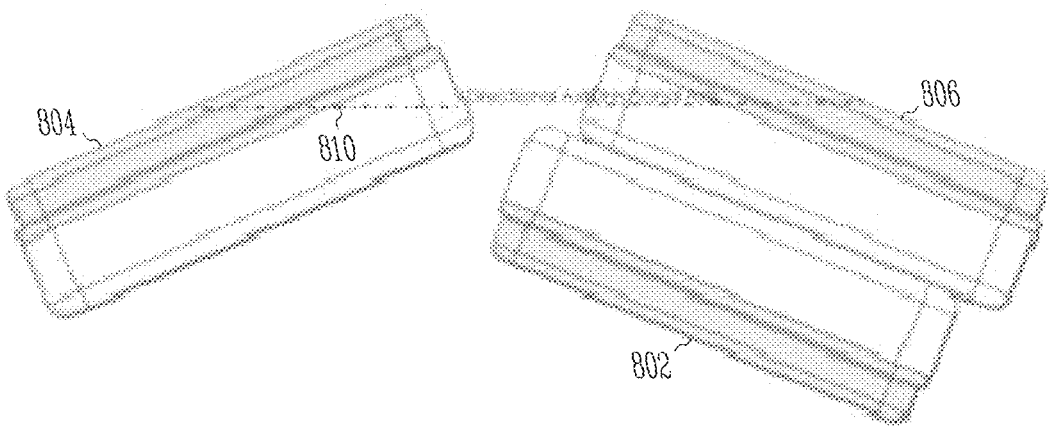

FIG. 8A illustrates a top view and FIG. 8B a side view of a DDO DMA, according to an embodiment of the present subject matter. Each microphone has an individual housing, and the housings have a parting line 810 to indicate the relative orientation of the internal microphone cartridge diaphragm, in the depicted embodiment. An omni microphone 802 contains one inlet 812 positioned on one side of the diaphragm parting line while a dipole microphone (804, 806) contains two inlets (814, 816) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 9A:
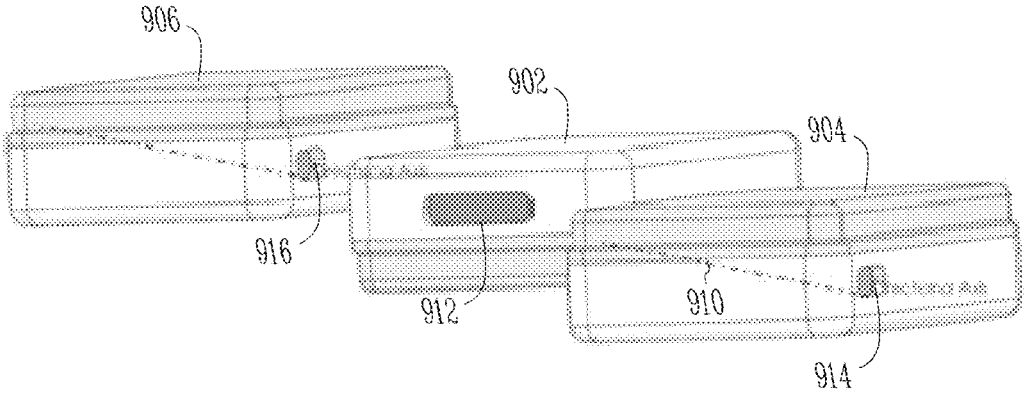
Figure 9B:
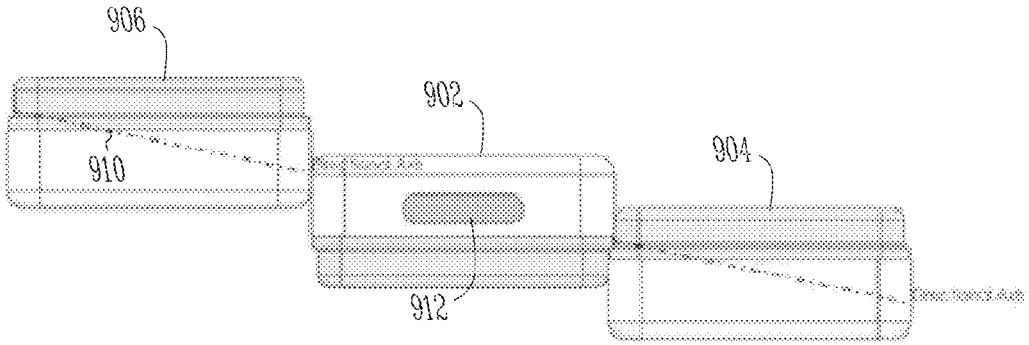
Figure 9C:
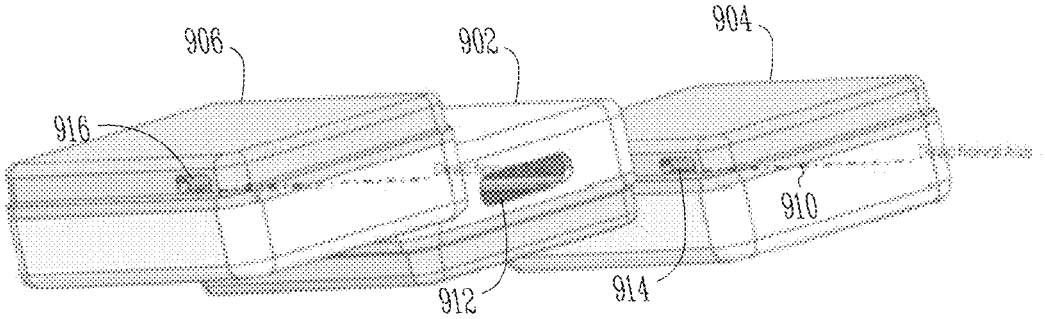

FIGS. 9A-9C illustrate top and oblique views of a DDO DMA, according to an embodiment of the present subject matter. Each microphone has an individual housing, and the housings have a parting line 910 to indicate the relative orientation of the internal microphone cartridge diaphragm, in the depicted embodiment. An omni microphone 902 contains one inlet 912 positioned on one side of the diaphragm parting line while a dipole microphone (904, 906) contains two inlets (914, 916) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 10:
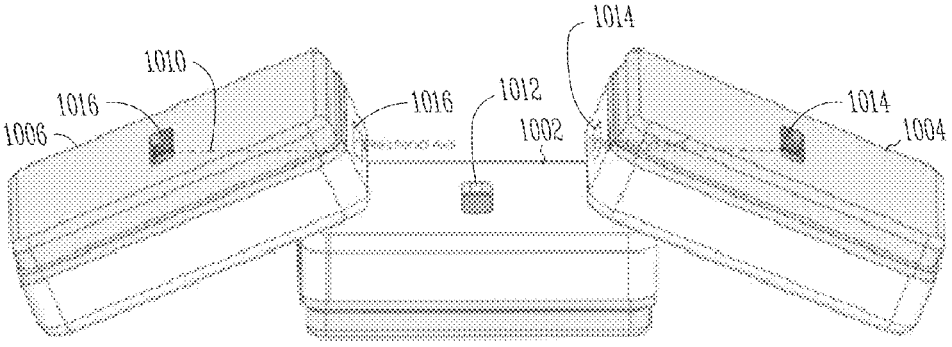

FIG. 10 illustrates an oblique view of a DDO DMA, according to an embodiment of the present subject matter. Each microphone has an individual housing, and the housings have a parting line 1010 to indicate the relative orientation of the internal microphone cartridge diaphragm, in the depicted embodiment. An omni microphone 1002 contains one inlet 1012 positioned on one side of the diaphragm parting line while a dipole microphone (1004, 1006) contains two inlets (1014, 1016) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 11:
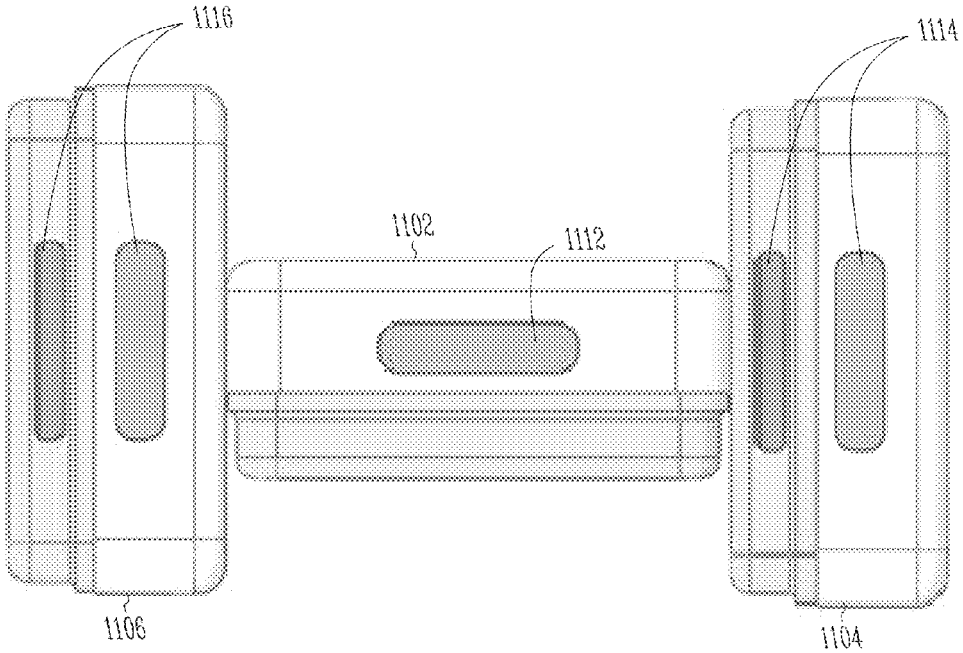

FIG. 11 illustrates a top view of a DDO DMA, according to an embodiment of the present subject matter. An omni microphone 1102 contains one inlet 1112 positioned on one side of the diaphragm parting line while a dipole microphone (1104, 1106) contains two inlets (1114, 1116) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 12:
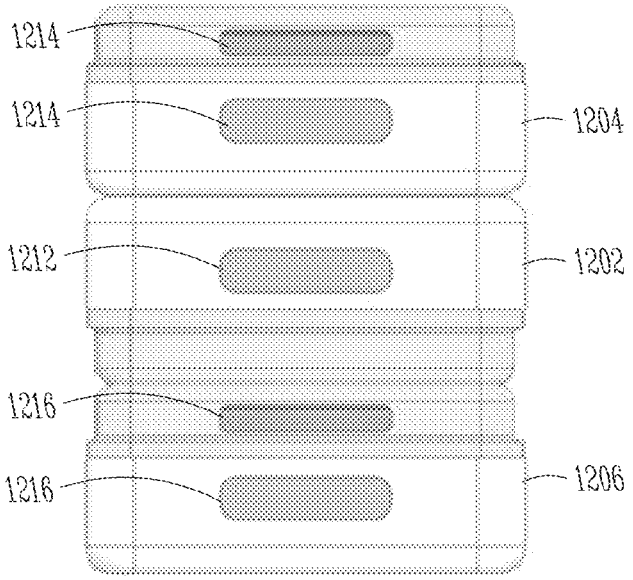

FIG. 12 illustrates a top view of a DDO DMA, according to an embodiment of the present subject matter. An omni microphone 1202 contains one inlet 1212 positioned on one side of the diaphragm parting line while a dipole microphone (1204, 1206) contains two inlets (1214, 1216) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 13:
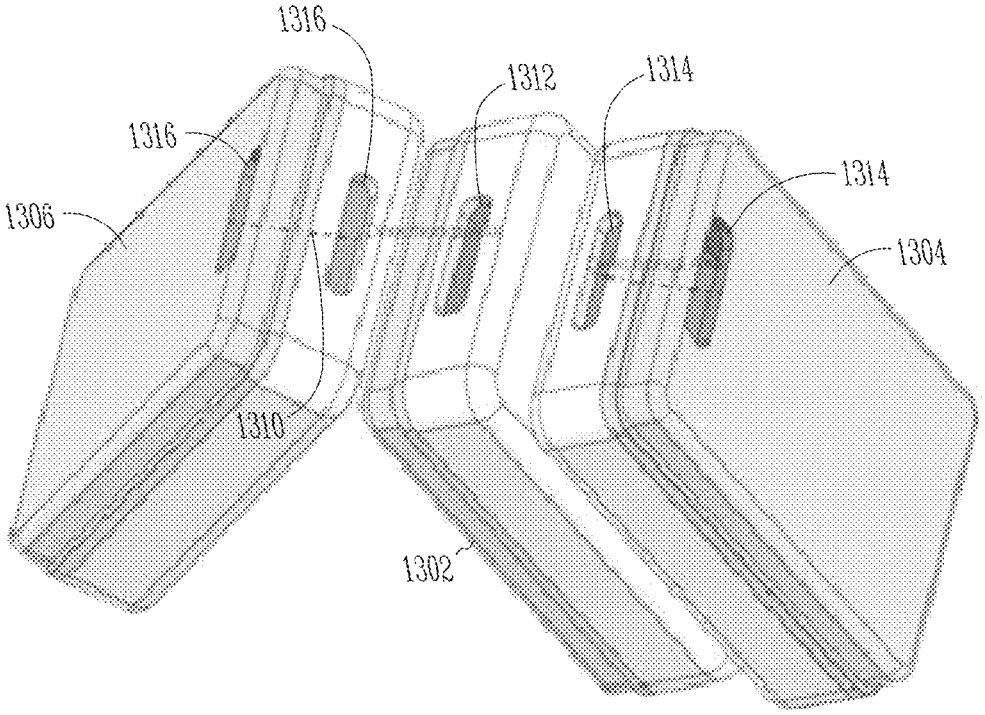

FIG. 13 illustrates an oblique view of a DDO DMA, according to an embodiment of the present subject matter. Each microphone has an individual housing, and the housings have a parting line 1310 to indicate the relative orientation of the internal microphone cartridge diaphragm, in the depicted embodiment. An omni microphone 1302 contains one inlet 1312 positioned on one side of the diaphragm parting line while a dipole microphone (1304, 1306) contains two inlets (1314, 1316) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 14:
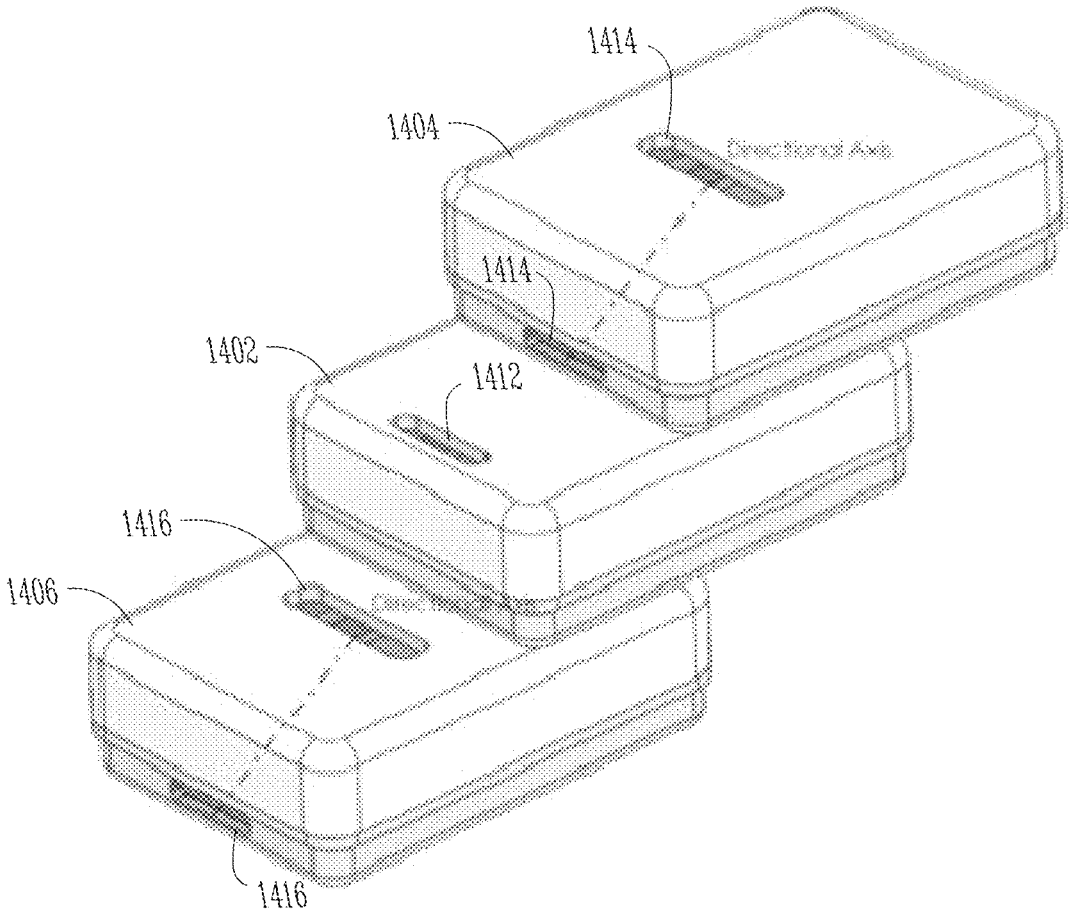

FIG. 14 illustrates an oblique view of a DDO DMA, according to an embodiment of the present subject matter. Each microphone has an individual housing, and the housings have a parting line 1410 to indicate the relative orientation of the internal microphone cartridge diaphragm, in the depicted embodiment. An omni microphone 1402 contains one inlet 1412 positioned on one side of the diaphragm parting line while a dipole microphone (1404, 1406) contains two inlets (1414, 1416) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 15A:
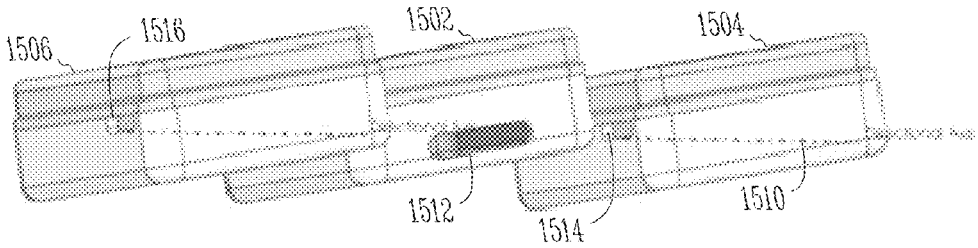
Figure 15B:
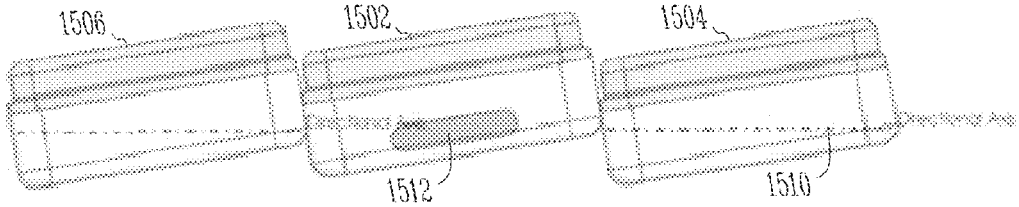
Figure 15C:
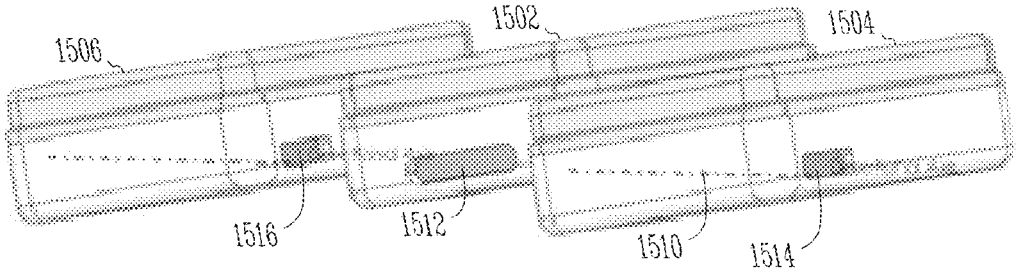

FIGS. 15A-15C illustrate top and oblique views of a DDO DMA, according to an embodiment of the present subject matter. Each microphone has an individual housing, and the housings have a parting line 1510 to indicate the relative orientation of the internal microphone cartridge diaphragm, in the depicted embodiment. An omni microphone 1502 contains one inlet 1512 positioned on one side of the diaphragm parting line while a dipole microphone (1504, 1506) contains two inlets (1514, 1516) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

Figure 16:
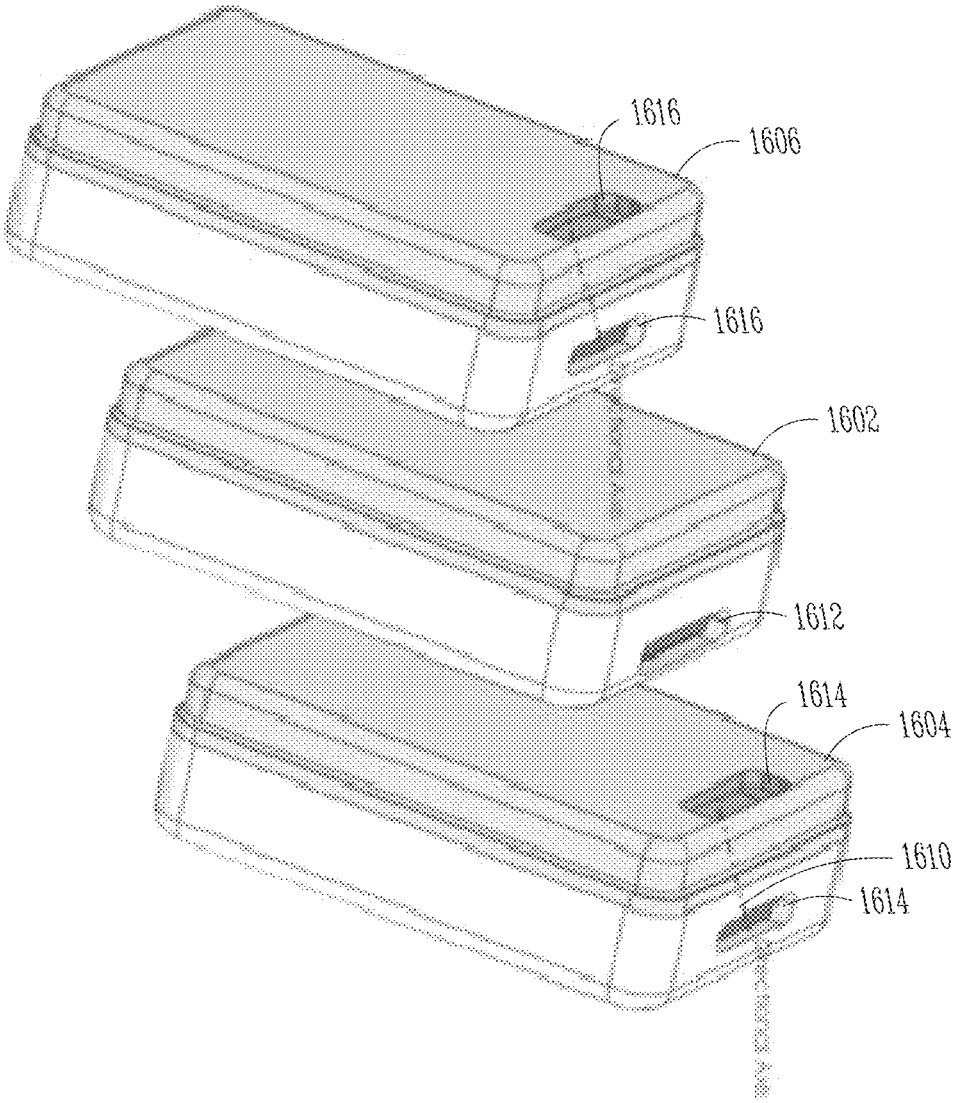

FIG. 16 illustrates an oblique view of a DDO DMA, according to an embodiment of the present subject matter. Each microphone has an individual housing, and the housings have a parting line 1610 to indicate the relative orientation of the internal microphone cartridge diaphragm, in the depicted embodiment. An omni microphone 1602 contains one inlet 1612 positioned on one side of the diaphragm parting line while a dipole microphone (1604, 1606) contains two inlets (1614, 1616) on either side of the cartridge, in various embodiments. According to various embodiments, the surface area of the dipole inlets is engineered to give the proper sensitivity and polar response. The directional axis of the dipole microphone is defined as the vector connecting the midpoint of each inlet. Dipole microphone inlets can be positioned to create various directional axes, in various embodiments. In various embodiments, the directional axes can be aligned by stacking the microphones appropriately. In addition, the omni microphone inlet can be positioned between the dipole inlets, such that the dipole inlets are symmetrically spaced on either side of the omni, according to various embodiments. The solder pads to the microphones are not shown, but can be placed anywhere on the microphone housings in various embodiments.

A dipole microphone can be characterized by its ratio of sensitivity (and phase) for 0° wavefront incidence (i.e., on-axis target direction) to 180° wavefront incidence. A perfect dipole has a 0°/180° ratio of 0 dB for all frequencies and the 180° wavefront is exactly out of phase with the 0° wavefront.

Since a dipole microphone has two acoustical inlets and senses the sound field at two locations, it is similar in some aspects to using two omnidirectional microphones and different in others. For example, a dipole microphone only has one cartridge and therefore consumes less electrical power. The DDO DMA herein is acoustically congruent to using five omni mics. However, since only three mics are used, it consumes 40% less electrical power. In addition, the five locations can be spaced relatively collinear within a 4 mm segment, thereby allowing easy integration inside the housing of a hearing instrument. Other sizes are possible without departing from the scope of the present subject matter.

Some second-order directional systems use multiple omni microphones or multiple dipole microphones. The directional performance of the former is susceptible to microphone mismatch and drift while the latter requires a wide spatial aperture to produce acceptable sensitivity, particularly at low frequencies. The DDO DMA configuration described in this application uses the combined output signals of all three microphones, thereby yielding higher sensitivities at low frequencies while achieving this in a small, compact package; specifically, less than a 4 mm segment (aperture).

There are infinite sets of absolute weights for each of the three mics that can be used to optimize directionality, in various embodiments. In certain embodiments, the relative weights between the mics remain congruent. Thus, if a second criterion is used to optimize the design, such as white noise gain, the aforementioned relative weights would remain congruent whereas the absolute weights may differ substantially (as compared to the design that is optimized for directionality alone).

Two dimensional directionality optimization is possible with this system. It is understood that this present system can be used to optimize directionality in three-dimensions, as opposed to other systems which attempt to do so only in two-dimensions.

It is much easier to manufacture a (near perfect) dipole microphone than it is to manufacture a pair of omnidirectional microphones with sensitivity and phase mismatch of 0 dB and 0 μsec, respectively. In addition, it is much easier to maintain the 0°/180° sensitivity ratio over age than it is to keep two omnidirectional microphones from drifting apart in sensitivity and phase over age. In the former, a single cartridge is used. In the latter, two cartridges are used, and it is difficult to control the latter's relative drift due to the intrinsic differences of their internal construction. Lastly, if the 0°/180° ratio of each dipole is kept within tight tolerance, the absolute sensitivity and phase of the two dipoles (that is to say, the sensitivity ratio of the 0° incidence for each dipole) can vary over many dB with little effect on the overall directional performance. For those skilled in the art of microphone design, it can be shown that the 0°/180° ratio of a dipole is a relatively stable quantity, regardless of temperature, humidity, or age drift, thereby making it an ideal candidate for robust DDO DMAs.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A microphone array system for receiving sounds, comprising:

a first directional microphone having a first directional axis in a first direction;

a second directional microphone having a second directional axis that is collinear with the first direction and pointing in the same direction as the first direction;

an omnidirectional microphone having a sound sampling position that is a disposed between the first directional microphone and the second directional microphone;

wherein the omnidirectional microphone sound sampling position is on or about the first directional axis and wherein weighted outputs of the first directional microphone, second directional microphone, and omnidirectional microphone are processed to provide a second order directional microphone system.

2. The system of claim 1, wherein the first directional microphone, the second directional microphone and the omnidirectional microphone are less than about 4 mm apart.

3. The system of claim 1, wherein the microphone array system is configured to be used to receive sounds for a hearing assistance device.

4. The system of claim 3, wherein the hearing assistance device includes a hearing aid.

5. The system of claim 4, wherein the hearing aid includes an in-the-ear (ITE) hearing aid.

6. The system of claim 4, wherein the hearing aid includes a behind-the-ear (BTE) hearing aid.

7. The system of claim 4, wherein the hearing aid includes an in-the-canal (ITC) hearing aid.

8. The system of claim 4, wherein the hearing aid includes a receiver-in-canal (RIC) hearing aid.

9. The system of claim 4, wherein the hearing aid includes a completely-in-the-canal (CIC) hearing aid.

10. The system of claim 4, wherein the hearing aid includes a receiver-in-the-ear (RITE) hearing aid.

11. The system of claim 3, wherein the hearing assistance device includes a cochlear implant.

12. A method of receiving sounds using a microphone array, the method comprising:

providing a first directional microphone having a first directional axis in a first direction;

providing a second directional microphone having a second directional axis that is collinear with the first direction and pointing in the same direction as the first direction;

providing an omnidirectional microphone having a sound sampling position that is a disposed between the first directional microphone and the second directional microphone, wherein the omnidirectional microphone sound sampling position is on or about the first directional axis; and processing weighted outputs of the first directional microphone, second directional microphone, and omnidirectional microphone to provide a second order directional microphone system.

13. The method of claim 12, wherein the first directional microphone is configured to receive sound and provide a signal to a frequency analysis process.

14. The method of claim 13, wherein the frequency analysis process includes a weighted overlap-add (WOLA) analysis.

15. The method of claim 13, wherein the frequency analysis process provides an output to a complex multiplication process to provide a first directional weighted output for the first directional microphone.

16. The method of claim 15, wherein the second directional microphone is configured to receive sound and provide a signal to a frequency analysis process.

17. The method of claim 16, wherein the frequency analysis process includes a weighted overlap-add (WOLA) analysis.

18. The method of claim 16, wherein the frequency analysis process provides an output to a complex multiplication process to provide a second directional weighted output for the second directional microphone.

19. The method of claim 18, wherein the omnidirectional microphone is configured to receive sound and provide a signal to a frequency analysis process.

20. The method of claim 19, wherein the frequency analysis process includes a weighted overlap-add (WOLA) analysis.

21. The method of claim 19, wherein the frequency analysis process provides an output to a complex multiplication process to provide an omnidirectional weighted output for the omnidirectional microphone.

22. The method of claim 21, wherein the first directional weighted output, the second directional weighted output, and the omnidirectional weighted output are added to obtain a resulting signal.

23. The method of claim 22, further comprising applying gain to the resulting signal.

24. The method of claim 23, further comprising applying gain shift to the resulting signal.

25. The method of claim 24, further comprising applying an output control limiting algorithm to the resulting signal.

26. The method of claim 12, wherein processing weighted outputs includes using a digital signal processor (DSP).

27. The method of claim 12, wherein processing weighted outputs includes using a microcontroller.

28. The method of claim 12, wherein processing weighted outputs includes using a hearing aid processor.

29. The method of claim 12, wherein processing weighted outputs includes using relative weights of the weighted outputs that are congruent.

30. The method of claim 12, wherein processing weighted outputs includes using absolute weights of the weighted outputs that are different.

* * * * *